United States Patent [19]

Matsumori

[11] Patent Number: 4,600,324

[45] Date of Patent: Jul. 15, 1986

[54] PRINT THIMBLE RECOGNIZING SYSTEM FOR A SERIAL PRINTER

[75] Inventor: Shigemitsu Matsumori, Tokyo, Japan

[73] Assignee: NEC Corporation, Tokyo, Japan

[21] Appl. No.: 551,533

[22] Filed: Nov. 14, 1983

[30] Foreign Application Priority Data

Nov. 12, 1982 [JP] Japan ..... 57-198583

[51] Int. Cl.[4] ..... B41J 1/32

[52] U.S. Cl. ..... 400/144.1; 400/175; 400/257

[58] Field of Search ..... 400/143, 144, 144.1, 400/144.2, 144.3, 144.4, 145, 145.1, 145.2, 149, 150, 151, 163, 171, 174, 175, 257

[56] References Cited

U.S. PATENT DOCUMENTS

| | | | |
|---|---|---|---|
| 3,949,853 | 4/1976 | Lahr et al. | 400/174 |
| 4,026,403 | 5/1977 | Inose et al. | 400/144.2 X |
| 4,037,707 | 7/1977 | Ku et al. | 400/144.1 |
| 4,074,798 | 2/1978 | Berger | 400/144.3 |
| 4,119,384 | 10/1978 | Keiter | 400/144.2 |
| 4,128,346 | 12/1978 | Ragland, III | 400/144.2 |
| 4,198,169 | 4/1980 | Stuiber et al. | 400/144.2 |
| 4,214,837 | 7/1980 | Bacher | 400/144.2 X |
| 4,281,938 | 8/1981 | Phillips | 400/144.2 X |
| 4,343,555 | 8/1982 | Abbott | 400/175 X |
| 4,386,862 | 6/1983 | Kittel et al. | 400/144.2 |
| 4,389,126 | 6/1983 | Honma et al. | 400/149 X |
| 4,411,539 | 10/1983 | Iwata et al. | 400/144.2 |
| 4,416,556 | 11/1983 | Iwata et al. | 400/144.2 |
| 4,425,846 | 1/1984 | Sakmann | 400/175 X |
| 4,448,555 | 5/1984 | Hasegawa | 400/144.2 |

FOREIGN PATENT DOCUMENTS

| | | | |
|---|---|---|---|
| 0033226 | 8/1981 | European Pat. Off. | 400/144.1 |
| 0098376 | 6/1982 | Japan | 400/144.2 |
| 0016870 | 1/1983 | Japan | 400/144.1 |
| 1604577 | 12/1981 | United Kingdom | 400/144.2 |

OTHER PUBLICATIONS

IBM Technical Disclosure Bulletin, "Key Identification System", Eliezer et al, vol. 19, No. 5, Oct. 1976, pp. 1548–1549.

IBM Technical Disclosure Bulletin, "Electronic Typewriter Type-Font Coding", Cooper, vol. 19, No. 11, Apr. 1977, p. 4242.

IBM Technical Disclosure Bulletin, "Font Identification", Dooley, vol. 22, No. 8A, Jan. 1980, p. 3051.

IBM Technical Disclosure Bulletin, "Means for Identifying One of a Plurality of Impact Printer Print Wheels", Kane, vol. 22, No. 11, Apr. 1980, pp. 4795–4796.

IBM Technical Disclosure Bulletin, "Low Cost Cartridge Code Detector", Craft, vol. 25, No. 4, Sep. 1982, pp. 1980–1981.

IBM Technical Disclosure Bulletin, "Single Senser for Carrier Homing and Print Wheel Identification", Quinn, Jr., vol. 25, No. 11A, Apr. 1983.

Xerox Disclosure Journal, "Print Wheel Sensing Scheme", Cocksedge et al, vol. 4, No. 3, May/Jun. 1979, p. 415.

*Primary Examiner*—Ernest T. Wright, Jr.

*Attorney, Agent, or Firm*—Sughrue, Mion, Zinn, Macpeak, and Seas

[57] ABSTRACT

In a printer adapted to receive any of a plurality of petal-type printing thimbles, each of the printing thimbles is provided with a recognition code-forming portion containing a plurality of protuberance-forming positions, the arrangement of protuberances at the protuberance-forming positions defining a thimble recognition code which identifies specific character position, hammer impression, and character spacing tables. These tables identify the character positions, hammer impression forces and character spacings required to print characters designated by character codes when the recognition code identified printing thimble is mounted on the printer. A mechanical means, mounted on the printing hammer cover of the printer carrier unit, detects the presence or absence of protuberances at the protuberance-forming positions of the code forming portion on the printing thimble, to generate a binary recognition code received by the printer processor. The mechanical means includes an electrical switch, selectively opened or closed by the presence or absence of protuberances.

18 Claims, 11 Drawing Figures

PRINT THIMBLE RECOGNIZING SYSTEM FOR A SERIAL PRINTER

BACKGROUND OF THE INVENTION

The present invention relates to a printing mechanism of a serial printer which can use any one of plural kinds of print thimbles. More particularly, this invention relates to a system for recognizing the kind of the print thimble interchangeably mounted on the serial printer.

In the serial printer of this type, the print thimbles can be interchanged. Print thimbles having characters different in size, type and number are prepared, and the user selects one of them according to the desired size, type and number of characters to be printed and mounts it on the printer.

The print thimble has a plurality of fingers that are formed like a petal or a wheel. A plurality of characters are arranged on the outer circumferential surface of the fingers. Arrangement, size and number of characters are different depending upon the kind of a print thimble. Therefore, for each character to be printed, the printer is required to change the impact position, hammer impression force and spacing amount of the carriage in the lateral directions, depending upon the kind of a print thimble which is mounted on the printer. It is therefore necessary for the printer to recognize the kind of the print thimble mounted thereon.

A variety of systems have been proposed to recognize the kind of print thimbles mounted on the printer. One example is disclosed in U.S. Pat. No. 4,074,798, wherein coded information identifying the kind of print wheel is formed at a predetermined position on the print wheel and is read by an optical sensor. Another example is disclosed in Japanese Patent Disclosure No. 98376/1982, wherein a magnetic film is stuck on a spoke at a position that varies depending upon the kind of print wheel. The magnetic film is detected by a magnetic sensor to recognize the kind of the print wheel.

However, in these recognition systems, the extra step of attaching optically recognizable coded information or a magnetic film to the print wheel is required in manufacturing steps of the print thimble, with the result that the manufacturing cost increases. Furthermore, because an optical sensor or a magnetic sensor is used to recognize the kind of a print thimble, the output thereof is disturbed by the dust adhering to the print wheel or by an external magnetic field making reliable recognition difficult. Further, a circuit for recognizing the output of the sensor is expensive.

SUMMARY OF THE INVENTION

It is, therefore, an object of the present invention to provide a novel print thimble recognizing system which can correctly and reliably recognize the kind of print thimble mounted on the printer under any environmental condition.

Another object of the present invention is to provide a print thimble which has a recognizing data code and can be manufactured without a substantial increase in cost.

According to the present invention, there is provided a print thimble recognizing system comprising the print thimble having protuberances in a coded manner and mechanical means for reading the coded information.

BRIEF DESCRIPTION OF THE DRAWING

The above-mentioned and other objects, features and advantages of the present invention will be better understood from the following detailed description of a preferred embodiment of the present invention taken in conjunction with the accompanying drawing, wherein:

FIG. 4(*b*) is a perspective view of a print thimble according to a second embodiment;

FIG. 5(*b*) is a sectional view of the print thimble along the line 5(*b*)-5(*b*) of FIG. 5(*a*);

Table 1 shows the relationships among recognition codes, character positions, hammer impressions and spacings employed in the preferred embodiment.

Tables 2(a) and 2(b) show the relationships between finger numbers and character positions.

Tables 3(a) and 3(b) show the relationships between character codes and characters.

Tables 4(a) and 4(b) show the relationships between character codes and character positions.

Tables 5(a) and 5(b) show the relationships between character codes and hammer impressions.

Table 6 shows the relationship between character code and spacings.

DESCRIPTION OF THE PREFERRED EMBODIMENTS

Figure 1:
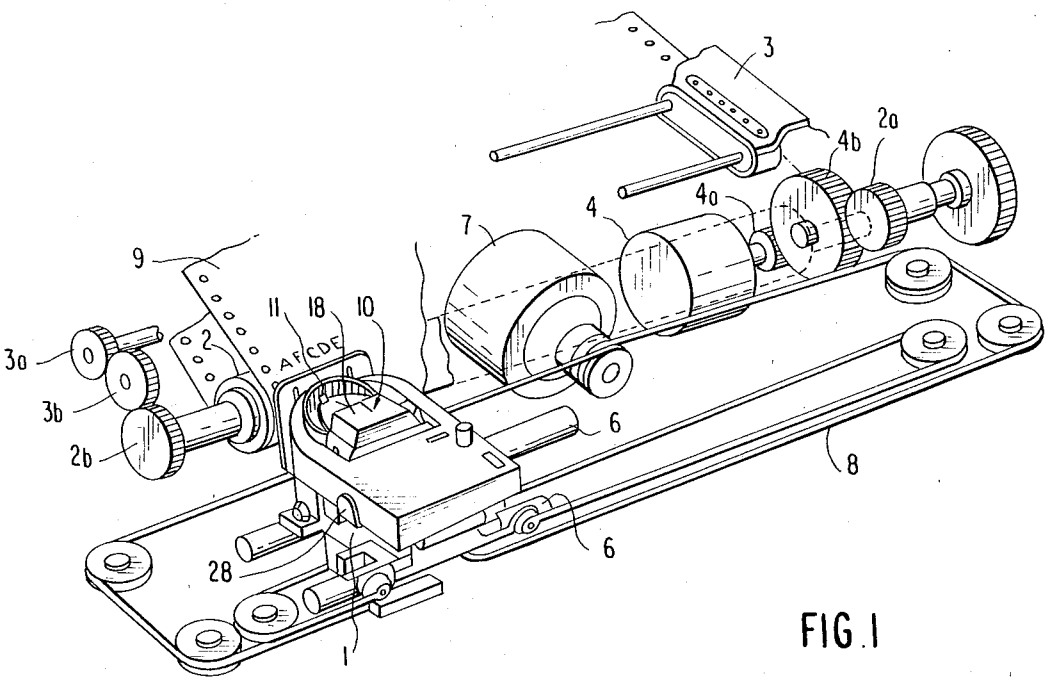
FIG. 1 is a perspective view illustrating major portions of a serial printer according to an embodiment of the present invention.

Referring to FIG. 1, a serial printer of the preferred embodiment comprises a carrier unit 1, a platen 2 located in front of the carrier unit 1, a tractor unit 3 for feeding paper 9 wound on the platen 2, and a paperfeed pulse motor 4 for actuating the platen 2 and the tractor unit 3. The platen 2 is provided with first and second platen gears 2*a* and 2*b* on the axially opposite sides thereof. The pulse motor 4 has a drive gear 4*a* which engages the first platen gear 2*a* via an idle gear 4*b* to rotate the platen 2. The rotation of the platen 2 is transmitted to a tractor gear 3*a* by the second platen gear 2*b* via an idle gear 3*b* to feed the tractor unit 3. The carrier unit 1 engages two guide shafts 6 via a plurality of guide bearings 5. The shafts 6 are secured in the printer. The carrier unit 1 is transported in a direction parallel to the platen 2 by a spacing motor 7 via a spacing wire 8.

The carrier unit 1 mounts a printing hammer mechanism 10, a petal-type print thimble 11, an inked ribbon cassette 12, and motors 15 and 16 (FIGS. 2 and 3) for driving them. The printing hammer mechanism 10 strikes a selected character on the print thimble 11 so that it is printed onto the paper 9. After the printing of each character, the carrier unit 1 is intermittently and laterally moved by the spacing motor 7. When one line of printing is completed the pulse motor 4 vertically increments the paper 9 by an amount equal to the distance between adjacent lines. Thereafter, the carrier unit 1 is intermittently moved again in the lateral direction so that characters are printed on the new line of the paper 9.

Figure 2:
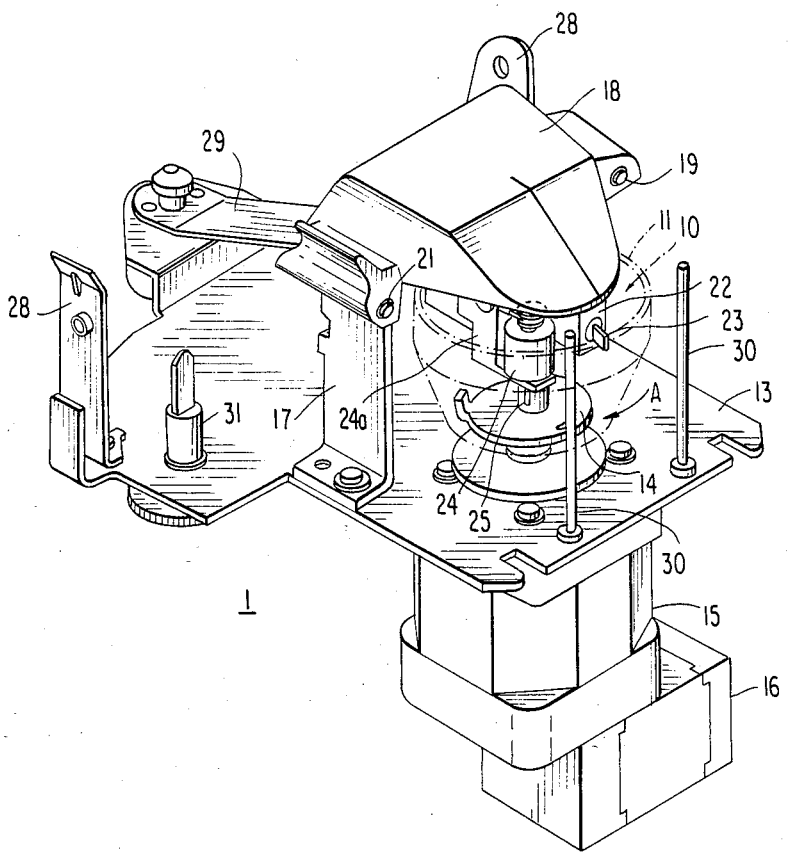
FIG. 2 is a perspective view of a carrier unit used in the embodiment shown in FIG. 1.
Figure 3:
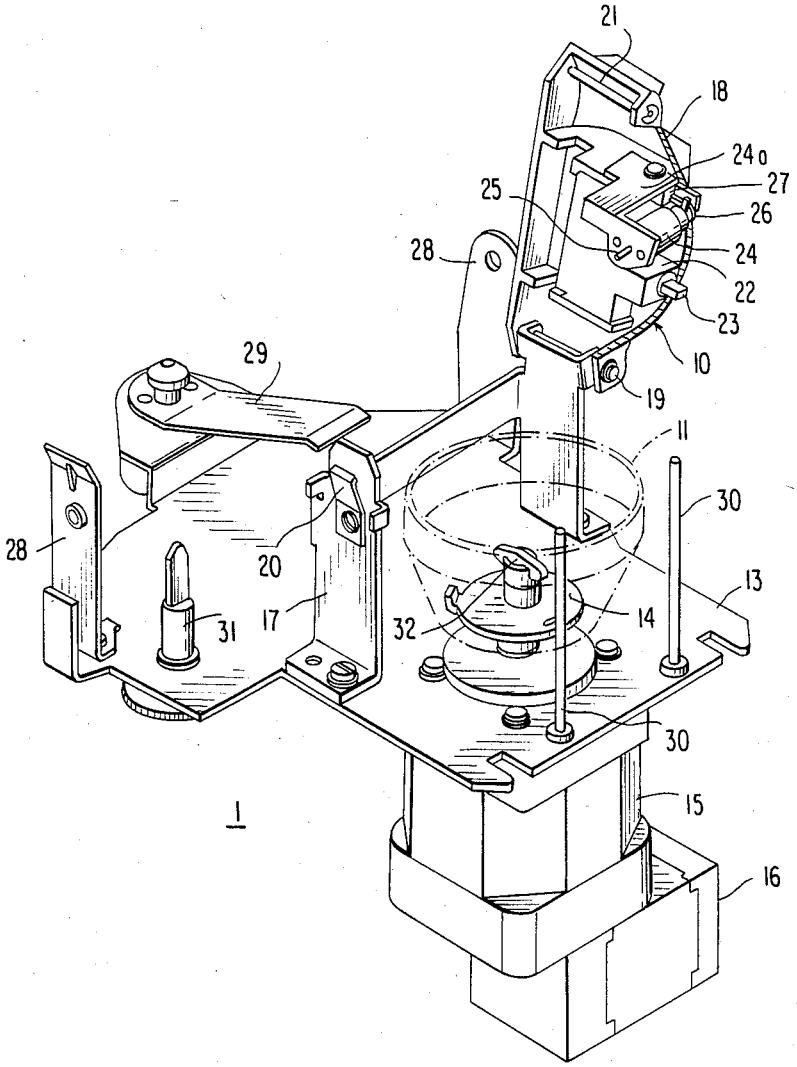
FIG. 3 is a perspective view of a carrier unit shown in FIG. 2 with its hammer cover opened.

Referring to FIGS. 2 and 3, the print thimble 11 is mounted via a mount unit 14 on a carrier base 13 of the carrier unit 1. The mount unit 14 engages with a shaft 15*a* (FIG. 7) of a stepping motor 15 which is provided under the carrier base 13, and is rotated by the motor 15. The shaft 15*a* (FIG. 7) of motor 15 also protrudes downwardly in the motor 15, and the lower portion of the shaft 15*a* engages with vertical selecting means 16 (see FIG. 7). Therefore, the print thimble 11 is rotated in the circumferential direction by the motor 15, and is also shifted in the vertical direction by vertical selecting means 16. The details of this character selecting mechanism especially of the vertical selecting means 16, has been described in U.S. patent application Ser. No. 477,833, entitled "Character Selecting Mechanism for a Serial Printer", filed on Jan. 23, 1981 by the applicant herein, which prior appplication is now abandoned. Therefore, it is not illustrated here any more.

A head support unit 17 stands on the carrier base 13 to support a hammer cover 18. One end of the hammer cover 18 is rotatably supported on the hammer support 17 by a pin 19, and the other end thereof has a pin 21 that engages with a stopper 20 of the hammer support 17. A hammer driver 22 attaches to the inner portion of the hammer cover 18 such that it is disposed facing the rear surface of the print thimble 11 when the cover 18 is closed (FIG. 2). A solenoid 24 is further provided on the inner portion of the cover 18 and is disposed on the side portion of the hammer driver 22 via a bracket 24*a*. The hammer driver 22 causes a print hammer 23 to protrude toward the platen 2 in the manner described in the U.S. Pat. No. 4,198,169. Therefore, a character formed on a finger 33 (FIGS. 4(*a*) and 4(*b*)) of the print thimble 11 and opposed to the print hammer 23 is impacted toward the platen 2, and is printed on the paper 9 via the inked ribbon. The solenoid 24 causes a plunger (detection pin) 25 to protrude toward the bottom of the print thimble 11 to detect protuberances 40*a* to 40*d* (FIGS. 4(*a*) and 4(*b*)) the kind of print thimble (details will be described later). A switch driving plate 26 is attached to the upper portion of the plunger 25. A switch 27 is provided on the inner portion of the hammer cover 18 and has a terminal 27' (FIGS. 6(*a*), 6(*b*) and 6(*c*)) with the plate 26. Further, arms 28 and a stopper 29 are provided on the carrier base 13 so that the inked ribbon cassette 12 (which is not illustrated in FIGS. 2 and 3) can be mounted. Ribbon guides 30 for guiding the inked ribbon, and a ribbon feed piece 31 engaging with the inked ribbon cassette 12 for running the inked ribbon are also provided.

To exchange the print thimble 11 secured onto the mount unit 14, the operator lifts up the hammer cover 18 (FIG. 3), and then, releases a fastening piece 32 that fastens the print thimble 11 to the mount unit 14. Thereby, the print thimble 11 can be removed from the mount unit 14 without interference from the hammer cover 18.

Referring to FIGS. 4(*a*) and 4(*b*), a petal-type print thimbles 11*a* and 11*b* consist of a plurality of (64) elastic fingers 33 that are arrayed in the form of a cup. Characters 34 and 35 are arranged on the upper portion and on the lower portion of fingers 33. Characters 34 and 35 are respectively arranged on the same circumferences of print thimbles 11*a* and 11*b*. A boss (engaging hole) 36 is formed at the rotational center on the circular bottom plate 11' of each of the print thimbles 11*a* and 11*b* in order to engage the mount unit 14. Each of the print thimble 11*a* and 11*b* includes a square hole 37 for aligning the print thimble 11 at a fixed angular index position with respect to the mount unit 14. The print thimbles 11*a* and 11*b* further have a code-forming portion 38 on the circular bottom plate 11' thereof, and the portion 38 includes positions 39*a*, 39*b*, 39*c* and 39*d* for forming protuberances. The recognition code of the print thimble 11 consists of protuberances 40*a*, 40*b*, 40*c* and 40*d* selectively formed on the four positions 39*a*, 39*b*, 39*c* and 39*d*. That is, the print thimble 11*a* has the protuberance 40*c* at the position 39*c* only. Therefore, its recognition code is "0010". The print thimble 11*b* has protuberances 40*a* and 40*d* at the positions 39*a* and 39*d*, and its recognition code is "1001".

Figure 5A:
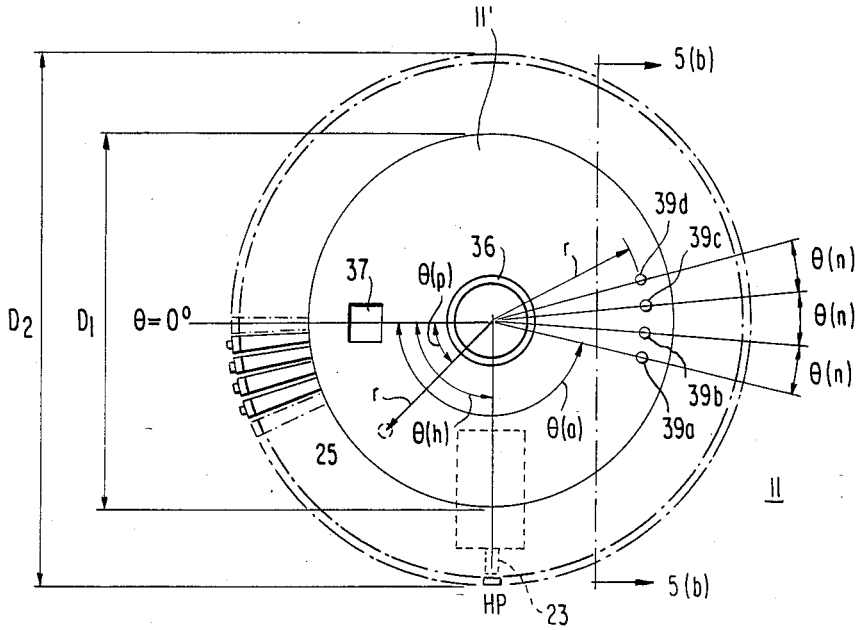
FIG. 5(*a*) is a plan view illustrating in detail the print thimble used for the carrier unit shown in FIG. 2.
Figure 5B:
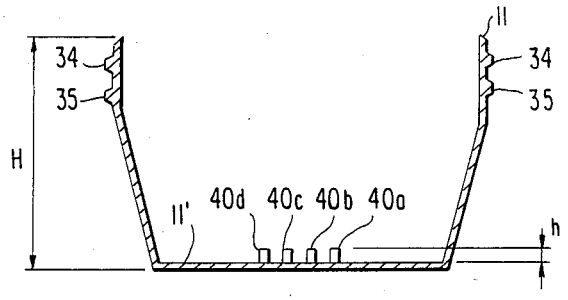

Referring to FIGS. 5(*a*) and 5(*b*), the print thimble 11 has a diameter $D_1$ of about 39 mm at the circular bottom plate 11', a diameter $D_2$ of about 52 mm at the upper portion, and a height H of about 26 mm. The protuberance-forming position 39*a* of the print thimble 11 defines an angle $\theta(a)=163°7'30''$ with respect to the square hole 37 ($\theta=0°$). The neighboring protuberance-forming positions have the same angle relative to each other, i.e., $\theta(n)=11°15'00'$. A home position HP of the print thimble 11 positions at an angle $\theta(h)=90°$ with respect to the square hole 37. The protuberance-forming positions 39*a*, 39*b*, 39*c* and 39*d* are arranged on the same circumference and are separated from the center 0 of rotation by a distance r=16 mm. Further, the protuberances 40*a*, 40*b*, 40*c* and 40*d* have a height h of about 1.5 mm at the most protuberant flat portion.

When the hammer cover 18 is closed (FIG. 2), the detection pin 25 of solenoid 24 is disposed such that it separates from the center 0 of the print thimble 11 by a distance r=16 mm (the same distance between the center 0 and the positions 39*a*, 39*b*, 39*c* and 39*d*). Further, when the home position HP of print thimble 11 is opposed to the hammer 23, the detection pin 25 is located at a position of an angle $\theta(p)=45°$ with respect to the square hole 37. Further more, when the solenoid 24 is not excited, the end of detection pin 25 is located at a position slightly higher than the upper surface of protuberances 40 with the print thimble 11 being lifted up by vertical selecting means 16 (i.e., in the state that characters 35 of the lower position of the print thimble 11 can be printed).

Figure 6C:
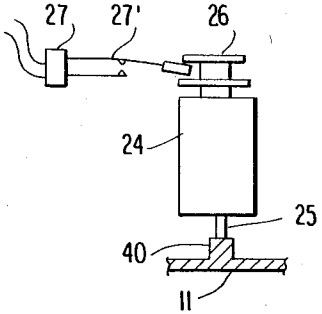
FIGS. 6(*a*), 6(*b*) and 6(*c*) are side views illustrating the operation of recognition code detection means employed in the carrier unit shown in FIG. 2.
Figure 6B:
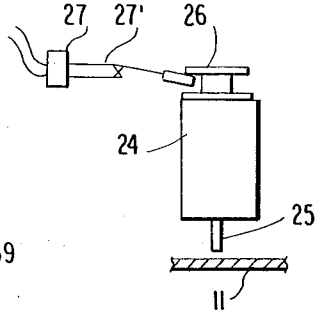
Figure 6A:
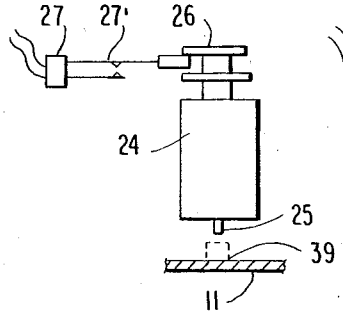

The principle for detecting the protuberances 40 relying upon the solenoid 24 will be described below in conjunction with FIGS. 6(*a*), 6(*b*) and 6(*c*). First, the print thimble 11 is turned such that the protuberance-forming position 39 is positioned under the detection pin 25 (FIG. 6(*a*)). Then, the solenoid 24 is energized to protrude the detection pin 25. In this case, if there is no protuberance at the protuberance-forming position 39 (FIG. 6(*b*)), the detection pin 25 can move downwardly by a predetermined amount. Accordingly, the plate 26 is also moved downwardly, and a contact point 27' of the switch 27 is closed to make the switch 27 conductive. This condition of switch 27 defines a binary code "0". If there is a protuberance 40 at the protuberance-forming position 39 (FIG. 6(*c*)), the detection pin 25 is prevented from moving downwardly by the protuberance 40. In this case, therefore, the plate 26 is moved downwardly only slightly, and the switch 27 remains in the non-conductive condition. The non-conductive position of switch 27 defines a binary code "1". Therefore, if this operation is repeated four times by rotating the print thimble 11 by a predetermined angle (11°15') each time, the recognition code consisting of four bits can be obtained.

Figure 7:
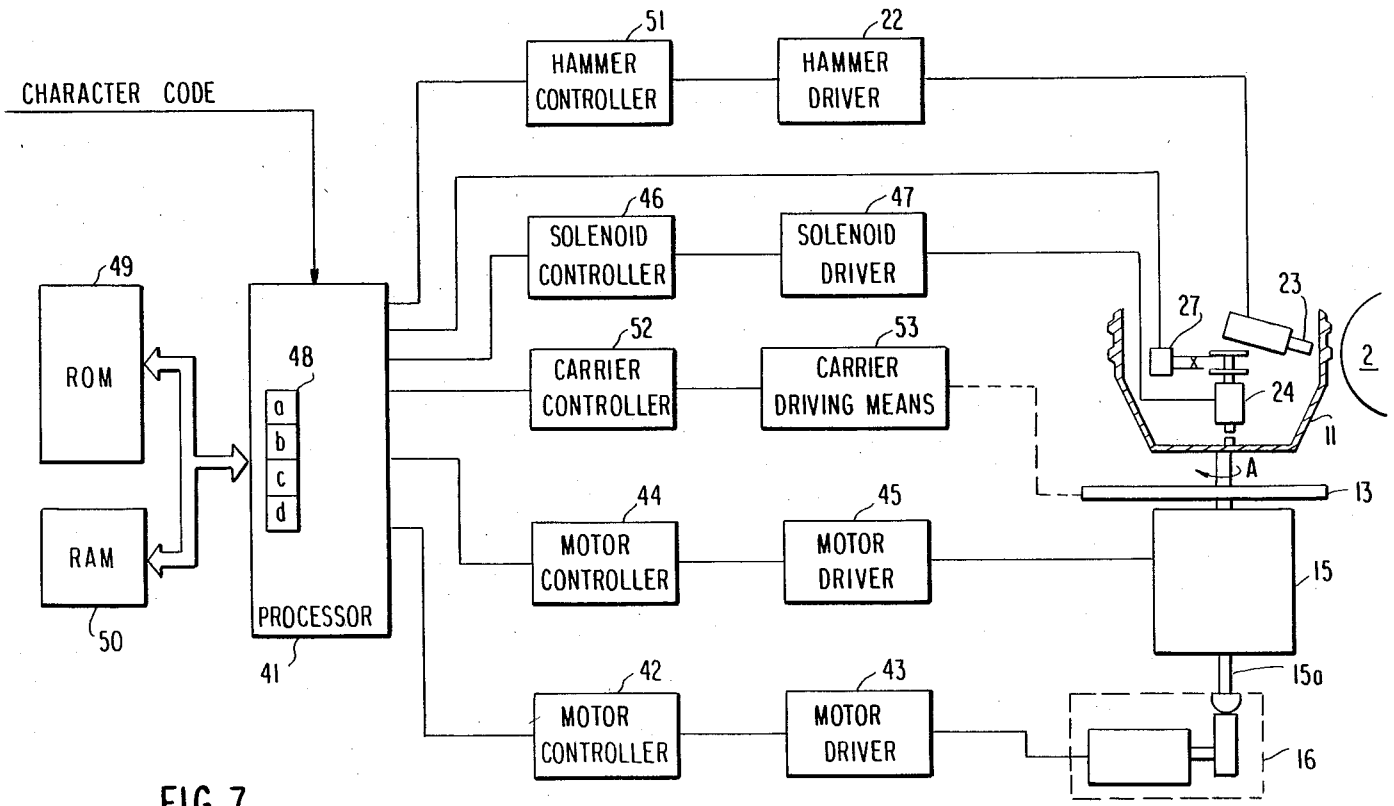
FIG. 7 is a block diagram illustrating the operation control of the serial printer of FIG. 1.

The operation of the printer when it recognizes the recognition code of the print thimble 11 will be described below. Referring to FIG. 7, first, a processor 41 which controls the printer, drives vertical selecting means 16 via a motor controller 42 and a motor driver 43 such that the print thimble 11 is upwardly shifted. Next, the processor 41 drives the motor 15 to rotate in the direction of arrow A via a motor controller 44 and a motor driver 45. After it is detected that the home position HP of the print thimble 11 is opposed to the hammer 23, the processor 41 further rotates the print thimble 11 in the direction of arrow A by 118°7'30" ($\theta$(a)-$\theta$(p)) (this angle corresponds to 21 steps of the motor 15). This causes the detection pin 25 of the solenoid 24 to be positioned above the protuberance-forming position 39*a* of print thimble 11 (refer to FIG. 5(*a*)). Then, the processor 41 energizes the solenoid 24 via a solenoid controller 46 and a solenoid driver 47. Thereby, the presence or absence of the protuberance 40*a* on the protuberance-forming position 39*a* is detected by the switch 27, and this information is provided to the processor 41. The processor 41 converts the turn on or turn off of the switch 27 into a binary signal and stores it in a bit a position in the register 48. Next, the processor 41 drives the motor 15 to turn the print thimble 11 in the direction of arrow A by 11°15' (=$\theta$(n)) (this angle corresponds to 2 steps of the motor 15). The detection pin 25 is thus opposed to the protuberance-forming position 39*b*. Again, the processor 41 energizes the solenoid 24, receives a signal corresponding to the switch 27, converts the signal into a binary signal, and stores it in a bit b position in the register 48. The same operation is then repeated twice more to detect the presence or absence of protuberances 40*c* and 40*d* on the protuberance-forming positions 39*c* and 39*d*, and the detection signals are stored as binary signals in the bit c and d positions of the register 48. The contents stored in the register 48 correspond to the kinds of print thimbles 11. For instance, when the print thimble 11*a* is mounted on the printer, the content of the register 48 is "0010".

The processor 41 then carries out the printing operation based upon the content of the register 48. A ROM 49 stores character position tables, hammer impression tables and carrier spacing tables for a variety of print thimbles 11. Depending upon the recognition code of the register 48, the processor 41 selects a character position, a hammer impression and a spacing table that are appropriate to the print thimble 11. Namely, at first, addresses that indicate storing positions in the ROM 49 are written into the RAM 50. Thereafter, after the processor 41 has received a character code, the processor 41 reads the position of the character type on the print thimble 11, which is represented by the character code, the hammer impression, and the lateral moving amount of carrier 1, which are best suited for the character type, from the ROM 49 with reference to RAM 50. The character position information is given to the motor controllers 42 and 44. Therefore, the motor 15 and vertical selecting means 16 position the character type, formed on the print thimble 11 and indicated by the character position code, between the hammer 23 and the platen 2. The hammer impression force information is given to a hammer controller 51. A hammer driver 22 then causes the hammer 23 to be protruded toward the platen 2 with an instructed impact strength. The spacing information is supplied to a carrier controller 52, whereby carrier drive means 53 causes the carrier unit 1 to move laterally by an instructed amount before the hammer 23 impacts the character type.

Operation of the above-mentioned printer will be described in more detail below with reference to accompanying Tables.

As shown in Table 1, the ROM 49 stores four tables P1, P2, P3 and P4 for positioning characters, nine tables I1 to I9 for hammer impression, and three tables S1, S2 and S3 for carrier spacing. Some print thimbles may require a certain spacing amount for all characters that are formed thereon. Such a spacing amount is represented by a constant numerical value in Table 1. The processor 41 selects tables for positioning characters, for hammer impression and for spacing, that correspond to the recognition code stored in the register 48. That is, when the recognition code is "1000", the table P1 is selected for positioning characters, the table I1 is selected for hammer impression, and 1/10 inch (constant for all characters) is selected for a spacing amount.

When the print thimble 11*a* shown in FIG. 4(*a*) is mounted on the carrier unit 1, the recognition code "0010" is stored in the register 48. The tables P2, I2, and the spacing amount of 1/10 inch are selected for this print thimble 11*a*. The print thimble 11*a* has character types arranged as shown in Table 2(a). That is, the character "A" is disposed on the upper portion of the 23rd finger of print thimble 11*a*, i.e., disposed at a character position 17, and the character "a" is disposed on the lower portion of the 20th finger, i.e., disposed at a character position 54. Table 3(a) shows the arrangement of characters corresponding to character codes used for the printer on which the print thimble 11*a* is mounted. That is, in the SI (Shift In) mode, a character code 41 designates the character "A" and in the SO (Shift Out) mode, the character code 41 designates the character "A" of italic type.

Table 4(a) shows a table P2 for positioning characters used for the print thimble 11*a*. As is obvious from this table, when 41 in the SI mode is input as a character code to the processor 41, the character position 17 of character "A" on the print thimble 11*a* is read from the ROM 49, and is supplied to the controllers 42 and 44. Further, when 61 in the SI mode is input as a character code, the character position 54 of character "a" on the print thimble 11*a* is read from the ROM 49.

Table 5(a) shows the table I2 of hammer impression forces used for the print thimble 11*a*. As is obvious from this table, when 41 in the SI mode is input as a character code to the processor 41, a impression level 5 ($=10\times10^4$ erg) suited for striking the character type "A" is read from the ROM 49, and is supplied to the hammer controller 51. When 3A in the SI mode is input as a character code (this character code represents ":" which requires a small printing pressure), a impression level 1 ($=5.5\times10^4$ erg) is read from the ROM 49. The spacing amount of the carrier unit 1 for the print thimble 11*a* is maintained constant (1/10 inch). This spacing amount is supplied to the carrier controller 52 before the hammer 23 is driven.

Next, when the print thimble 11*b* shown in FIG. 4(*b*) is mounted on the carrier 1, the code "1001" is stored in the register 48. The tables P1, I9 and S3 are selected for this print thimble 11*b* (refer to table 1). Table 2(b) shows the arrangement of characters on the print thimble 11*b*, table 3(b) shows characters corresponding to character codes, table 4(b) shows the table P1 that is selected for positioning characters, table 5(b) shows the impression table I9, and table 6 shows the spacing table S3. As will be obvious from table 2(b), the character "A" is disposed at a character position 34 of print thimble 11*b*, which is different from that of the print thimble 11*a*. The number of character types is also different from that of the print thimble 11*a*. Therefore, table P1 is selected to designate the character position on the print thimble 11*b*. Also, the table I9 is selected to designate impact strengths for each of the characters on the print thimble 11*b*. When the print thimble 11*b* is mounted, it is required to change the spacing amount of carrier unit movement between characters depending upon the characters that are to be printed. For this purpose, therefore, the spacing table S3 is selected. Table 6 illustrates the table S3 identified with reference to Table 1. When a character code 57 in the SI mode, which designates "W", is input to the processor 41, the ROM 49 produces the spacing value of 8 ($\times 1/120$ inch). This valve is supplied to the carrier controller 52. When a character code 49 in the SI mode, which designates "I", is input (in this case, the carrier unit 1 needs to be moved a smaller amount than when "W" is designated), the spacing value 3 ($\times 1/120$ inch) is read from the ROM 49 and is supplied to the carrier controller 52. The carrier controller 52 adds together the designated spacing value and that of the preceding character that has just been printed, to determine an actual spacing amount for the carrier unit 1.

According to the present invention as described in the foregoing, a recognition code consisting of a plurality of protuberances is provided at the recognition code-forming position of the print thimble, and is read by a mechanical means. Therefore, the recognition code can be formed simultaneously with the formation of the print thimble by molding, and it enables the manufacturing cost of the print thimble to be reduced. Further, the recognition code reading means reads the recognition code correctly and stably without any disturbance due to the change of ambient temperature, external magnetic field, dust adhered on the print thimble, and so on.

What is claimed is:

1. A serial printer comprising:

a print thimble including a plurality of elastic fingers, a plurality of character types formed on said plurality of elastic fingers, and protuberances selectively formed on a recognition code-forming area identifying the print thimble;

detection means for detecting the presence or absence of said protuberances at said recognition code-forming area of said print thimble to produce a detection signal, said detection means including a solenoid having a plunger which is capable of being protruded and switching means engaging said plunger whereby the opening and closing of said switching means is controlled by the movement of said plunger, said solenoid being disposed in alignment with said recognition code-forming area of said print thimble so as to be able to mechanically contact said protuberances; and means for recognizing the kind of said print thimble in response to said detection signal.

2. The serial printer as claimed in claim 1, wherein said plurality of elastic fingers of said print thimble are arranged in the form of a petal, and said character types are arranged along the vertically different circumferences of a set of said plurality of elastic fingers.

3. The serial printer as claimed in claim 2, wherein said recognition code-forming area is located on the inside, bottom surface of said petal-type print thimble.

4. The serial printer as claimed in claim 1, further comprising a print hammer disposed to face the rear surface of said plurality of elastic fingers of said print thimble, a hammer cover plate to which said hammer is attached, said detection means also being attached to said cover plate such that said detection means and said print hammer are arranged in a predetermined relation with respect to each other.

5. The serial printer as claimed in claim 4, wherein said plate can be opened and closed to facilitate insertion and removal of said printing thimble.

6. The serial printer as claimed in claim 1, further including:

a platen;

guide shafts; and a carrier unit engaging said guide shafts for lateral movement of said carrier unit along said guide shafts in the axial direction of said platen;

said carrier unit including a carrier base plate and hammer cover plate, said carrier base plate including means for mounting said print thimble, said hammer cover plate including means for mounting said detection means.

7. The serial printer as claimed in claim 6, further including; a printing hammer mechanism composed of a hammer driver and print hammer, said printing hammer mechanism being mounted on said hammer cover plate, said detection means being mounted on said hammer cover plate in predetermined relationship to said hammer driver by said mounting means for the detection means.

8. The serial printer as claimed in claim 7, wherein; said means for mounting said print thimble comprises a mount unit, said carrier unit further includes a stepping motor with a shaft and vertical selecting means, said print thimble being attached to said mount unit, the shaft of said stepping motor engaging said mount unit and extending into engagement with said vertical selecting means, whereby the rotation of said shaft of said stepping motor causes rotation of said mount unit and in turn the print thimble and said vertical selecting means produces axial movement of said shaft of said stepping motor, said axial movement being transmitted to said print thimble through said mount unit.

9. The serial printer as claimed in claim 8, wherein; said print thimble further includes a circular bottom plate, one end of each of the plurality of elastic fingers being attached to a portion of the bottom plate to form a petal array of elastic fingers about a circumference of the bottom plate, there being formed two pluralities of characters along vertically different circumferences of a set of said plurality of elastic fingers, said recognition code-forming area being located on said bottom plate at a selected radius from the rotational center of said bottom plate, said bottom plate further including an aligning hole for aligning said print thimble at a fixed angular index position, said recognition code-forming area being located a defined angular distance from said aligning hole, said protuberances being selectively located at defined protuberance-forming positions within said recognition code-forming area, the distance between adjacent protuberance-forming positions being equal and equal to an integer multiple of the stepping distance of said stepping motor.

10. The serial printer as claimed in claim 9, wherein said detection means is mounted on said hammer cover plate such that said plunger is disposed for registration with said protuberance forming positions.

11. The serial printer as claimed in claim 10, further including:

vertical motor controller means and vertical motor driver means;

stepping motor controller means and stepping motor driver means;

solenoid controller means and solenoid driver means;

means for energizing said vertical and stepping motor controller means and driver means to axially move said print thimble in a direction toward said plunger while rotating said print thimble to bring a first protuberance-forming position in registration with said plunger;

means for energizing said solenoid controller means and driver meanse to cause said plunger to extend toward the protuberance-forming position in registration with said plunger; and means for incrementing said print thimble predetermined distances to successively bring each of said protuberance-forming positions in registration with said plunger;

said detection means further including a switch driving plate attached to said plunger, and said switching means having a terminal engaging said switch driving plate;

whereby extension of the plunger without contacting a protuberance causes said switching means to assume a first state of conduction, while extension of the plunger to contact a protuberance causes said switching means to assume a second state of conduction.

12. The serial printer of claim 11, further including; processor means for converting the states of said switching means into a machine readable printing thimble recognition code, memory means storing several tables of codes of character positions, hammer impression forces and character spacings, said machine readable printing thimble recognition code designating at least one of said stored tables for operating said printer in response to a character code.

13. The serial printer of claim 12 further including; a hammer controller and driver, and a carrier unit controller and driver, said hammer and carrier unit controllers and drivers being responsive to the codes stored in the designated tables for controlling hammer impression force and character spacing.

14. A serial printer comprising: a print thimble including a plurality of elastic fingers arranged in the form of a cup, a plurality of character types arranged along vertically different circumferences of a set of said plurality of elastic fingers, a recognition code-forming portion located near the rotational center of said print thimble, and protuberances formed on said recognition code-forming portion, a recognition code being formed by the combination of the present of absence of said plurality of protuberances;

a rotating motor including a shaft for rotating said print thimble, said shaft also being movable in the axial direction thereof;

drive means engaged with said shaft for moving said shaft in the axial direction thereof;

solenoid assembly having an extendable detection plunger and switching means for detecting the presence or absence of said protuberances, said switching means engaging said plunger whereby the opening and closing of said switching means is controlled by the movement of said detection plunger, said solenoid assembly being located to be opposed to said recognition code-forming portion of said print thimble on a preselected rotation of said rotating motor and in contact with a protuberance when the shaft is extended in its axial direction simultaneously with said rotation of said motor;

conversion means for converting the detected result of said detection means into a binary signal; and means for recognizing said binary signal as a recognition code, whereby said printer recognizes the kind of said print thimble in response to said recognition code.

15. A print thimble to be mounted on a carrier unit of a serial printer, said carrier unit including a solenoid with an extendable plunger comprising:

a plurality of elastic fingers arranged in the form of a petal;

a plurality of character types arranged along a circumference of a set of said plurality of elastic fingers;

a circular bottom plate for fastening one of the ends of said plurality of elastic fingers to form a unitary structure;

an engaging hole formed at the position of the rotational center of said circular bottom plate;

a recognition code-forming portion provided at a predetermined position on said circular bottom plate;

a plurality of protuberance-forming positions provided on said recognition code-forming portion, said plurality of protuberance-forming positions having an equal distance form said engaging hole; and at least one protuberance selectively provided on said protuberance-forming positions, said at least one protuberance having a substantially flat surface at the most protuberant portion thereof such that the presence or absence of said at least one protuberance can be detected by the protrusion of the plunger of the solenoid provided on said carrier unit when opposite said recognition code-forming portion, said plunger engaging switching means for detecting the collision of said plunger with said flat surface when said solenoid is energized, a discrimination code being defined by the presence or absence of said at least one protuberance.

16. The print thimble as claimed in claim 15, wherein said circular bottom plate further includes a square hole for aligning said print thimble at a fixed angular index position.

17. The print thimble as claimed in claim 16, wherein said recognition code-forming portion is situated a predetermined distance from said aligning hole and each of said protuberance-forming positions are each formed equidistance from its adjacent protuberance-forming positions.

18. The print thimble as claimed in claim 17, further including a home position (HP) located a predetermined distance from said aligning hole.

* * * * *

UNITED STATES PATENT AND TRADEMARK OFFICE

CERTIFICATE OF CORRECTION

PATENT NO. : 4,600,324

DATED : July 15, 1986

INVENTOR(S) : Shigemitsu MATSUMORI

Figure 4B:
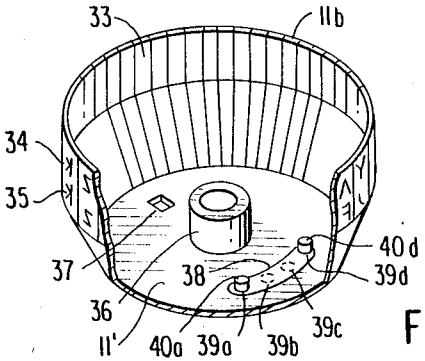
FIG. 4(*a*) is a perspective view of a print thimble to be used in the carrier unit of FIG. 2 according to a first embodiment.
Figure 4A:
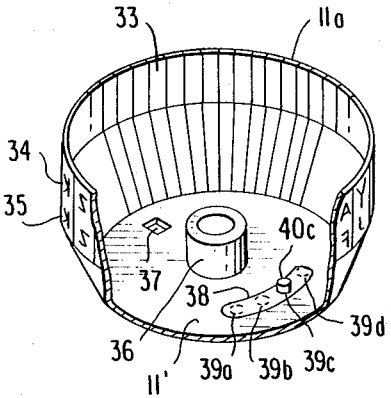

It is certified that error appears in the above-identified patent and that said Letters Patent is hereby corrected as shown below:

Column 3, Line 45, after "(Figs. 4(a) and 4(b))", insert --that indicate--.

Column 3, Line 50, after "and 6(c))", insert --that engages--.

Signed and Sealed this

Third Day of February, 1987

*Attest:*

DONALD J. QUIGG

*Attesting Officer*

*Commissioner of Patents and Trademarks*